US005373995A

United States Patent [19]

Johannson

[11] Patent Number: 5,373,995

[45] Date of Patent: Dec. 20, 1994

[54] VENTED REFINER AND VENTING PROCESS

[76] Inventor: Ola M. Johannson, 5528 29th Ave. NE., Seattle, Wash. 98105

[21] Appl. No.: 111,757

[22] Filed: Aug. 25, 1993

[51] Int. Cl.[5] ..... B02C 7/12

[52] U.S. Cl. ..... 241/17; 241/18; 241/28; 241/253; 241/261.2; 241/261.3; 241/296

[58] Field of Search ..... 241/15, 17, 18, 23, 241/28, 250, 251, 253, 257.1, 260, 261.2, 261.3, 296, 297, 298

[56] References Cited

U.S. PATENT DOCUMENTS

| | | | |
|---|---|---|---|
| 259,974 | 6/1882 | Burns | 241/261.3 X |
| 3,674,217 | 7/1972 | Reinhall | 241/296 X |
| 3,745,645 | 7/1973 | Kurth et al. | 241/296 X |
| 4,023,739 | 5/1977 | Lampe et al. | 241/296 |
| 4,090,672 | 5/1978 | Ahrel | 241/296 X |
| 4,221,631 | 9/1980 | Hellerqvist et al. | 162/23 |
| 4,676,440 | 6/1987 | Perkola | 241/261.3 |
| 4,712,745 | 12/1987 | Leith | 241/261.3 |
| 5,181,664 | 1/1993 | Kohler | 241/261.3 |

*Primary Examiner*—Timothy V. Eley
*Attorney, Agent, or Firm*—Robert W. Beach

[57] ABSTRACT

In a refiner having ribbed refining disks to form a refining zone between such disks, the refining spaces of such disks including radial ribs forming grooves between them, which grooves are blocked at intervals by dams connecting the ribs at opposite sides of the grooves, and intergroove slots connect neighboring grooves in an arrangement to provide venting passages for steam forming a zigzag course which bypasses the refining zone between the refining disks.

5 Claims, 4 Drawing Sheets

VENTED REFINER AND VENTING PROCESS

BACKGROUND OF THE INVENTION

1. Field of the Invention

This invention relates to a refiner, namely, a machine that gives mechanical treatment to wood chips and fiber for paper stock, which refiner is vented to release steam from the refining zone, and to the process of venting the refining zone of a refiner.

2. The Problem

In refiners, pulp fibers are shredded between closely spaced disks having shredding surfaces with generally radial ribs forming approximately radial grooves between them. The relative motion of the ribs rolls and tears the fiber material and the material is progressively refined into pulp. The working of the fiber material will be referred to as shredding effected by fiber to rib impacts, friction between the pulp and the ribs and rubbing of fiber on fiber.

In order to maximize the shredding action of the ribs, the coacting ribbed disks are placed close together to form a thin refining zone between them, but the friction and shredding of the fibers between the refining disks produces a large amount of heat. The pulp fibers usually have a high water content (30 percent to 90 percent by weight) and, in addition, water may be added to the fiber mass to avoid excessively high temperatures and to optimize the fiber friction. The temperatures produced, however, are sufficiently high to vaporize water and generate great amounts of steam in the refining zone, as discussed in Hellerqvist U.S. Pat. No. 4,221,631, issued Sep. 9, 1980, at column 1, lines 27 to 30 as follows:

> From this water, great amounts of steam are generated as energy is added during the refining operation on the fiberous material. This steam passes out of the refining space together with the refined material . . .

Efforts to solve problems caused by the steam are discussed at column 1, beginning at line 41, as follows:

> Prior efforts to alleviate the problems associated with the generation of steam between the refining discs have involved withdrawing of steam from the central space between the refining discs. For example, Canadian Pat. No. 974,958, issued Sept. 23, 1975, for 'Apparatus for Treatment of Cellulose Containing Material' discloses an apparatus and method in which steam generated during refining is withdrawn and discharged into the housing surrounding the refining discs through central openings close to the axis of rotation of the refining disc. That is, steam is withdrawn through openings arranged radially inward of the feed opening for the cellulose chips being introduced between the refining discs. While such arrangements have helped to relieve some of the problems associated with the generated steam, they have not been totally satisfactory, especially with respect to maintaining the stability of the refining gap and to assuring a uniform flow of material therethrough.

In an effort to prevent fiber being swept out of the refining zone by steam being vented, and thus decreasing the shredding action of the ribbed discs on the fibers in the refining zone, dams spaced radially of the ribbed discs have been formed in the grooves between the refining ribs so that the fibers cannot be swept without restraint along the grooves by the action of the steam being vented and the centrifugal force produced by rotation of one or both disks.

While such dams interrupt free flow of fiber radially along the disk grooves, the fibers tend to pack in the groove pockets formed between the dams so that much of the fiber simply orbits segregated from the fiber in the refining zone and thus reduces the shredding capacity of the refiner without corresponding improvement in the refining action.

At the same time, clogging of the grooves by dams between which fiber packs blocks the passage for escape of steam from the refining zone so that the pressure of the steam between the disks has increased, and the great steam pressure makes it difficult to maintain a constant distance between the refiner disks as stated in Perkola U.S. Pat. No. 4,676,440, issued Jun. 30, 1987, at column 1 lines 25 to 33:

> In big grinders operated at considerable power levels, vaporization of the water contained in the wood produces so much steam that, because of the steam pressure, it is difficult to maintain a constant distance between the grinder cutters, which is important in view of product quality. Moreover, the steam bursting out of the grinder in an uncontrolled manner often involves significant trouble in the supply of material into the grinder.

In addition to larger friction forces, an increase in kinetic energy due to the clogged grooves will require more power to turn the disks.

To reduce the steam pressure between the disks by increasing the venting of the steam, it has been proposed to increase the cross-sectional area of the grooves between the refining ribs, but such expedient has simply increased the size of the pockets in which fibers can pack that merely orbit removed from the refining zone with a relatively small increase in the venting area.

Prior Art

The Perkola U.S. Pat. No. 4,676,440, issued Jun. 30, 1987, attempted to solve the steam venting problem, stating at column 1, beginning at line 50:

> An advantageous embodiment of the invention is characterized in that the exhaust channels serve primarily to exhaust the steam produced in the grinding process, and that the velocity of the steam flowing in the exhaust channel depends on the sectional area of the channel, and that when the velocity of the exhaust steam is over 10 m/s or about 10–50 m/s, the defibrated material is drawn by the steam flow into the exhaust channel and thus removed from the space between the cutters. As the defibrated material is quickly removed by the steam flow, over-grinding of the fibres is prevented, while less energy is consumed in the process.

The difficulty has been that the fibrous material has not been overground but has been insufficiently refined.

This patent provides special exhaust channels for venting steam, as described in column 2, lines 35 to 43:

> The sectional area 9 of the exhaust channel 7 is considerably larger than that of a conventional groove 6 between the cutter teeth, which means that the steam is efficiently exhausted through the channel. If the exhaust channel 7 is made to correct dimensions so as to provide an appropriate passage for the amount of steam produced, the violent flow of steam carries the finest material, i.e. the fibers, along with it out of the grinder.

In any event, the additional channels have dams or partial dams in them, as stated in column 2, lines 57 to 60:

> Additional edge formations 12 or protrusions 13 at the bottom of the exhaust channel may also be incorporated to control the amount or kind of material that can be carried along by the steam flow.

In other words, the addition of large venting channels apparently is comparable to increasing the size of the radial grooves between the refining ribs and, if the dams are deleted or reduced in height to reduce the deterrence of outward flow along the grooves, the effectiveness of the dams to prevent premature discharge of insufficiently refined fiber is correspondingly reduced. The effectiveness of the refining is greatly reduced with the addition of large venting channels since some ribs have to be removed and others will be significantly reduced in length.

Premature discharge of insufficiently refined fiber poses the greatest problem in the portion of the refining zone closest to the peripheries of the refining disks because the centrifugal force and steam velocity are greater in the circumferential portions of the disk grooves. Recognizing this aspect of the problem, the Kohler U.S. Pat. No. 5,181,664. issued Jan. 26, 1993, proposes to incline the refining ribs and consequently the grooves between them forwardly in the direction of plate rotation indicated by the arrow 106 in FIG. 1. Also, the ribs in the radially outer section of the refining zone do not have dams between them, whereas the radially inner section forming the primary refining zone 18 does have dams 34 in the grooves 32, as stated at column 3, line 65 to column 4, line 9:

> In order to maintain this material in the second refining zone 18 as long as possible, each groove 32 has at least one, and preferably two, dams 34. As shown in FIG. 3, these dams 34 are preferably surface dams (but could be subsurface dams), which means that the dams extend upwardly so that the top surface 36 is at the same elevation as the top surface of the adjacent bars 30. As described above, the dams 34 interrupt the flow of material through the grooves 32, forcing the material onto the adjacent bars for further refining. In the second refining zone 18, substantial quantities of steam are also generated, producing a steam flow with high radially outward velocity.

In explaining how the inclined bars 36 and grooves are considered to alleviate the problem, Kohler states at column 4, beginning at line 62 (emphasis supplied):

> As a result of the angular orientation of the bars 36 and grooves 38 in the outer refining zone 20, and the centrifugal forces acting on the steam and partially refined fibers, a natural separation of steam and fibers occurs in an advantageous manner. The steam, unimpeded by dams in the channels 38, flows relatively easily through the channels and exhausts at the outer edge 24. The fiber, being heavier, is thrown toward the trailing wall 46 of each groove 38 and is thereby forced onto the upper surface of the trailing bar 36, for additional refining action.

Kohler still maintains the dams in the grooves of the inner section as stated beginning at column 5, line 29:

> In any event, the invention contemplates an inner zone or pattern of substantially radially oriented bars 30 and narrow inner grooves 32 having dams for interrupting the radial flow of material therethrough, and an outer zone 20 of outer bars 36 and wide outer grooves 38 defining flow channels 48 extending from the inner pattern 18 to the outer edge 24 of the plate at an angle of at least about 45 degrees relative to the inner grooves 32. The channels 48 extend from the grooves 32 of the inner zone 18, to the outer edge 24 of the plate, substantially in the direction of disc rotation 106, and have little or no dam structure for interrupting flow.

The Leith U.S. Pat. No. 4,712,745, issued Dec. 15, 1987, discusses the problem of orbiting fiber material packed in pockets between radial ribs and dams, stating at column 2, line 61:

> Fluid-resonant oscillations mainly due to the radial slot profile provide the tuned resonant cavity mode for various sized wood chips . . . , and for slot resonance with internal dams forming a series of resonance cavities when filled with any combination of wood chips, wood fibers, water, steam or air.

This patent points out disadvantages at column 3, lines 12 to 14:

> a high power input due to wasted energy with large fluid-dynamic drag, much noise, and considerable erosion loss with an untuned resonating cavity.

The structure of the refiner in this patent is discussed at column 6, lines 6 to 13:

> The slots defined between the bars have a parallel radial profile 21, each slot having a horizontal bottom surface 21*a*. A multiplicity of dams 22, shown in section B—B, are located and spaced in each of the slots of the slot profile 21. The dams 22 are evenly spaced in each slot, but staggered in parallel slots, and at mid-line radial bar crossings, can produce a cellular standing wave that can cause a steam flow restriction called rotating stall.

SUMMARY OF THE INVENTION

A principal purpose of the invention is to provide an effective vent for steam vaporized in the refining zone between the refiner disks while reducing the amount of fiber swept from between the refining disks by the steam being vented. Specifically, it is an object to deposit fiber from the steam along the course which it follows in being vented. More specifically, it is an object to deposit fiber from the steam being vented along a course which includes a number of abrupt changes in direction by inertia of the fiber at each change in course direction which deters it from following the course of the steam being vented.

Another object is to expedite the refining of the fiber to an acceptable degree of fineness. A more specific object is to expedite the refining operation by returning fiber repeatedly to the refining zone between the refining disks.

It is also an object to increase the capacity of the refiner and shorten the time required to accomplish a predetermined degree of refinement.

A further object is to reduce the power required to effect relative rotation of the refining disks in order to accomplish a predetermined refining operation. More specifically, it is an object to reduce orbiting of packed fiber by the refining disks, which packed fiber is not subjected to any appreciable refining action.

Another object is to provide a refiner of small size for its capacity.

An additional object is to reduce the axial thrust load induced on the bearings and refiner stand by reducing the steam pressure between the disks.

It is also an object to control the direction of the steam vented from the refining zone. By correctly sizing the slots, the steam can, because of the pressure difference, all be forced outward toward the periphery, or some of the steam can be forced inward toward the center of the disks.

The foregoing objects can be accomplished by a refiner having relatively rotatable coaxial coacting disks providing refining surfaces formed by radial ribs and alternating grooves, which grooves are blocked at intervals by dams, but circumferential slots interconnect neighboring grooves adjacent to the dams. Moreover, the dams in adjacent grooves are out of circumferential registration so that the intergroove slots and groove portions between the slots provide a zigzag course for venting steam from between the refining disks to the periphery of such disks along a zigzag course bypassing the refining zone between the refining disks.

DETAILED DESCRIPTION

Figure 1:
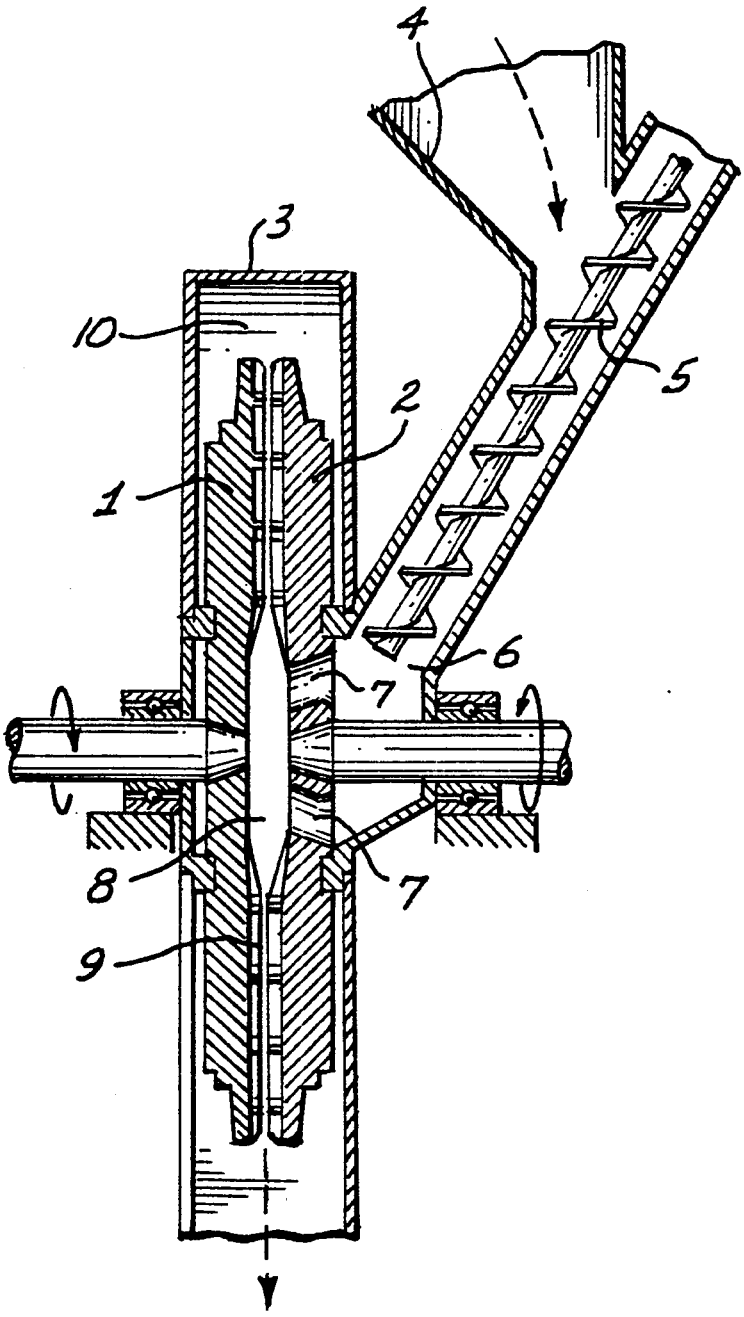
FIG. 1 is a diagrammatic vertical axial section through a refiner to which the present invention relates.

A refiner for pulp fiber of the type to which the present invention relates consists primarily of two coacting coaxial refining disks 1 and 2 relatively rotatively mounted in a housing 3. Such disks can be flat or conical. The disks can be rotated in opposite directions or only one of the disks can be rotated and the other disk will be fixed. Fiber material to be refined can be deposited in a hopper or pressure vessel 4 and fed into a central feeding compartment 6 such as by a screw conveyor 5. From such compartment, the material to be refined can pass through apertures 7 in the central portion of one of the disks 2 into the space 8 located centrally of the refining disks. The refining disks are spaced apart slightly to form the refining zone 9 between them.

Figure 3:
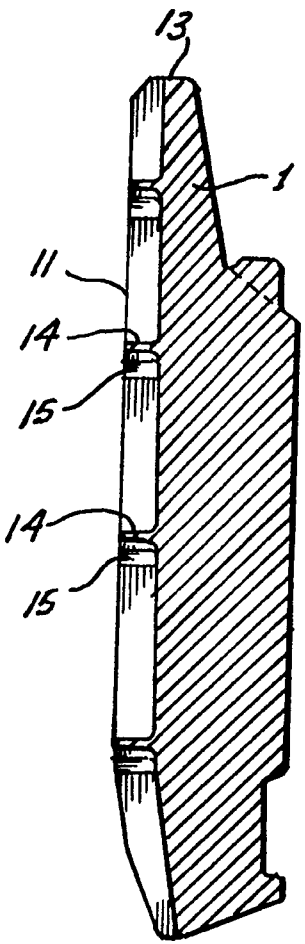
FIG. 3 is a section through such disk taken line 3—3 of FIG. 2.
Figure 2:
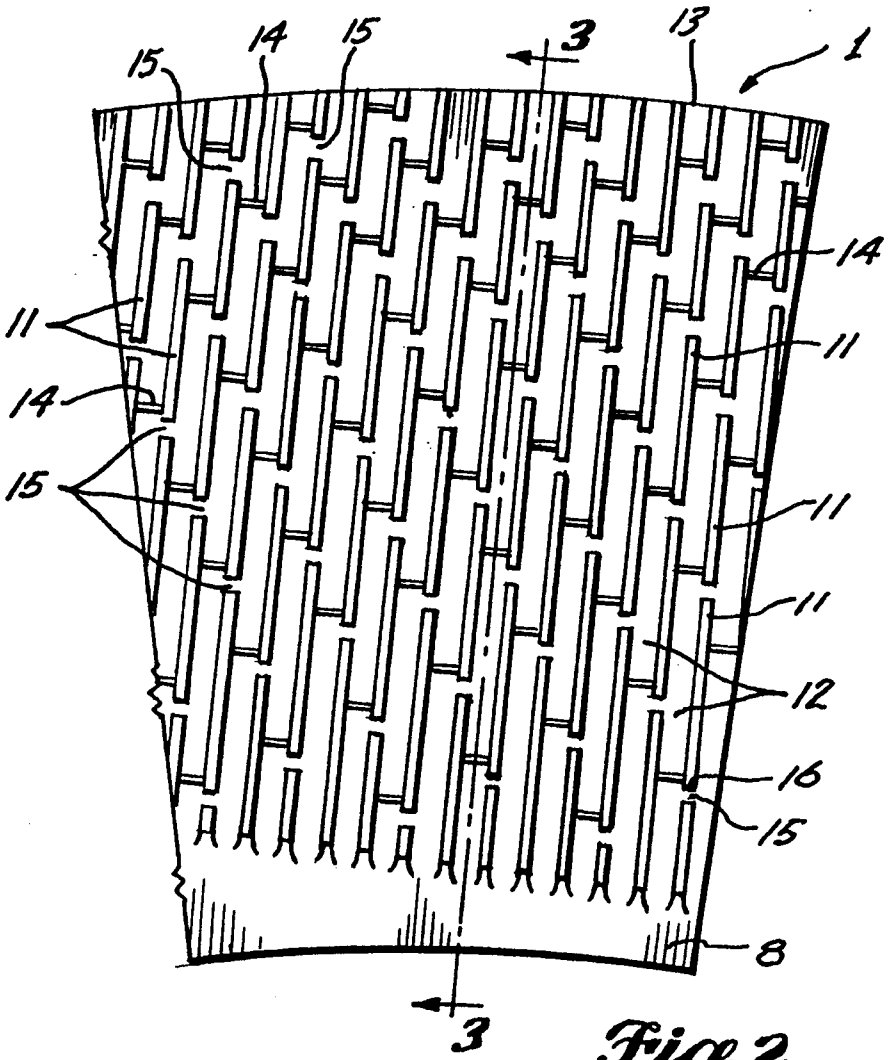
FIG. 2 is a fragmentary face view of a portion of a refining disk.

Fiber material to be refined is propelled by centrifugal and steam forces from the central space 8 between the refining disks into and generally radially through the refining zone 9 for discharge into the annular space 10 within housing 3 encircling the disks. Refining of the fibers to fibrils is accomplished in the refining zone 9 by the shredding action of ribs 11 carried by and extending generally radially of the refining disks, as shown in FIGS. 2 and 3. These ribs are spaced apart circumferentially to form approximately radial grooves 12 between them.

The grooves 12 may be of rectangular cross section or may be flared to a greater or lesser extent. The grooves in general form passages for fibrous material radially outwardly alongside the refining zone 9, but the material being refined does not principally travel uninterruptedly lengthwise of the grooves. Instead the fibrous material is tumbled in the Grooves by the relative rotation of the refining disks so that the fibers emerge repeatedly from the grooves into the refining zone 9 for further shredding during the passage of the fibers between the central chamber 8 and the peripheral annular chamber 10 of the refiner.

The shredding action of the fiber in the narrow refining zone 9 causes a large amount of friction between the refining disks and the fiber and between fibers in the refining space which produces considerable heat. The fiber material being refined usually has rather a high water content, and water may be added to such material prior to or during the refining process in order to optimize refining temperature and consistency. The heat produced by the mechanical work tends to be confined in the refining zone, so that the temperature in such zone customarily exceeds the boiling point of water. The heat produced by such work is largely dissipated by vaporization of water in the refining zone to steam. Such heating may be sufficient to pressurize the steam to a greater or lesser extent if it is not vented promptly.

The grooves 12 between the ribs 11 in the faces of the refining disks can extend unobstructedly to the periphery 13 of the refining disks. In such case, steam generated in the refining zone 9 is vented comparatively easily by the steam flowing radially outwardly through the grooves 12. Such flow of steam along the grooves, however, carries with it fiber material before it has been refined sufficiently by being shredded in the refining zone 9.

To prevent free flow of fiber radially through the grooves 12 propelled by steam being vented so that the fiber material is discharged from the periphery 13 of the refining zone 9 or inward into the central cavity 8 prematurely, in some refiners at least three and preferably more dams 14 have been provided at radially spaced intervals in the grooves 12 to deter the radial flow of fiber through such grooves. While the deterrence of flow of fiber through the grooves by the dams has been somewhat beneficial, such construction has the disadvantage of also restricting the venting of steam through the grooves so that the steam pressure in the refining space 9 tends to increase to undesirably high values, and the dams have formed pockets in the refining surfaces of the disks into which fiber tends to pack, so that it simply orbits with the disks instead of emerging frequently from the grooves into the refining space between the ribs 11. Such plugging of the grooves reduces the refining efficiency of the refiner and also reduces its refining capacity.

Figure 4:
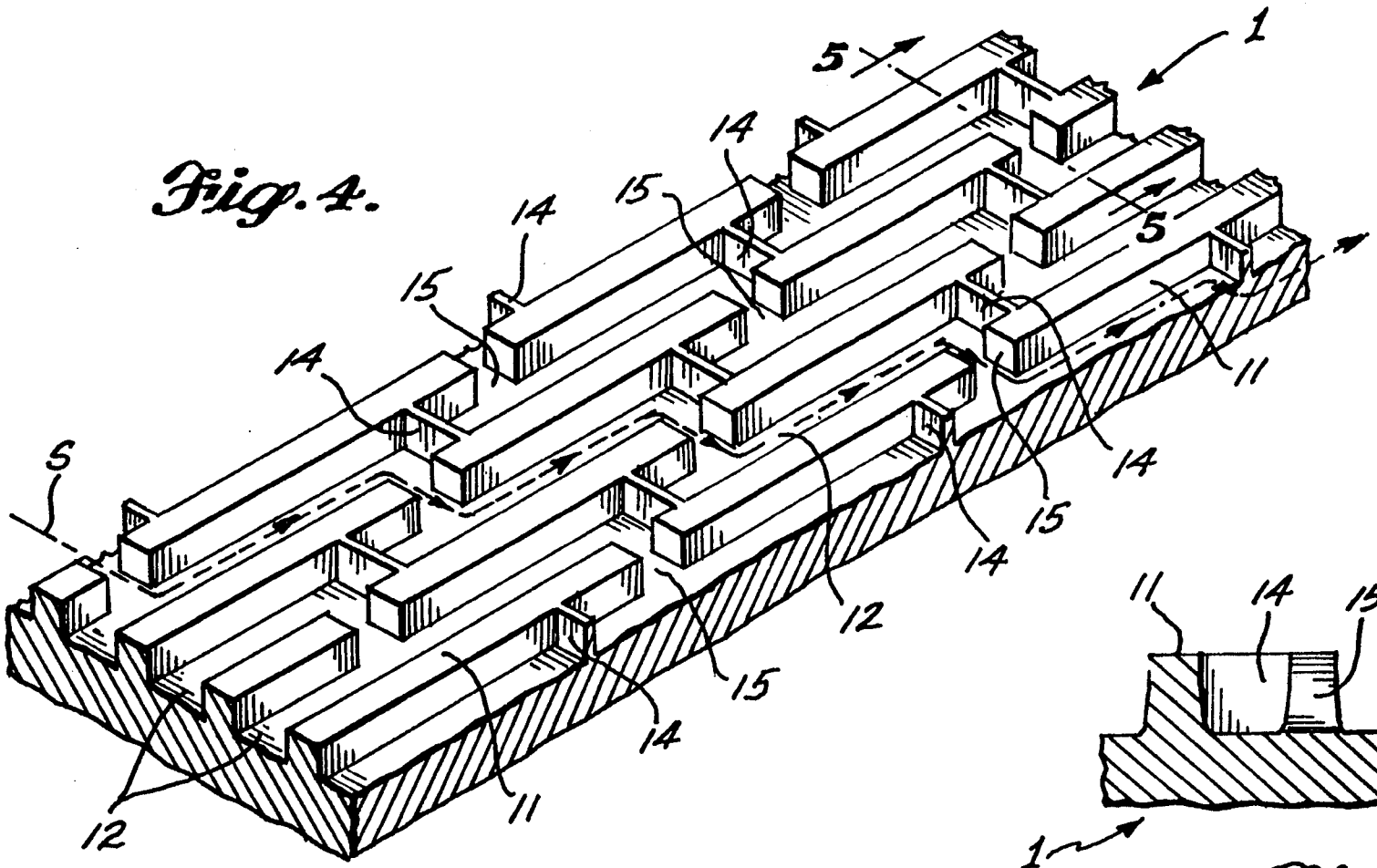
FIG. 4 is a fragmentary enlarged top perspective of a portion of a refining disk according to the present invention.
Figure 5:
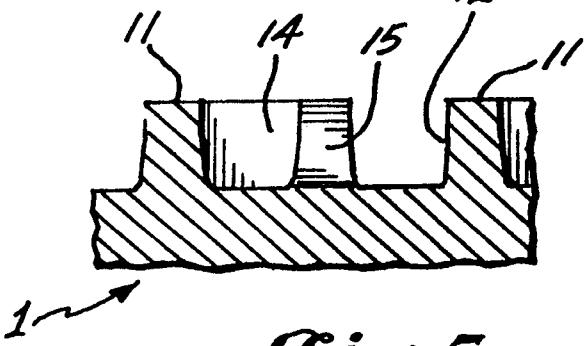
FIG. 5 is a detailed section through a portion of the disk taken on line 5—5 of FIG. 4.

The present invention provides intergroove slots 15 as shown in FIGS. 2, 4 and 5 which are located in one of the ribs forming each groove at a location adjacent to and preferably slightly radially inwardly of each dam as shown in FIGS. 2 and 4. The effect of such slots is to provide a zigzag passage for steam through grooves 12 bypassing the refining zone 9 as indicated by the broken line S in FIG. 4.

Because of its fluidity, steam can be vented through such zigzag course comparatively readily, whereas fiber material borne by such steam tends to be deposited at the radially inner side of each dam 14 at which location the steam vent course changes because of the inertia of such fiber material. Being blocked by a dam 14, the inertia of such fiber material tends to boost it over the dam into the radially outward portion of the refining space 9.

The provision of the intergroove slots 15 therefore promotes clearing of the grooves from fiber which would tend to pack in the groove segments if there were no positive circulation through them. Also the dams induce depositing from the steam of fiber borne by the steam flow which passes over the dams into the radially outer portions of the refining space instead of simply being swept by the steam generally radially of the inter-disk space bypassing the refining zone 9.

Since steam is continuously generated in the entire refining zone 9 throughout the radial extent of the disks, if the steam is flowing outward the steam generated between the inner portions of the disks must pass outward between the outer portions of the disks in addition to the steam generated between the radially outer portions of the disks. It may be desirable to increase the cross-sectional area of the venting path near the circumference 13 of the disks over that in radially inner portions of the disks. Consequently, it may be desirable to space the intergroove slots 15 radially closer together in radially outer portions of the disks than in radially inner portions of the disks so that there will be more intergroove slots in the radially outer portions of the disks than in the radially inner portions of the disks as shown in FIG. 2. In addition or alternatively, it may be desirable to make the slots closer to the peripheries of the disks wider than the slots closer to the central portions of the disks as also shown in FIG. 2. Moreover, it may be desirable for the grooves to flare radially outward.

In addition, it is desirable for the slots 15 in neighboring ribs to be misaligned circumferentially to provide the zigzag course.

While the intergroove slots 15 are located adjacent to dams 14, it may be desirable to provide a lip 16 on a rib between a dam 14 connected to that rib and the slot 15 adjacent to such dam to form a shallow pocket at the radially inner side of each dam.

Figure 6:
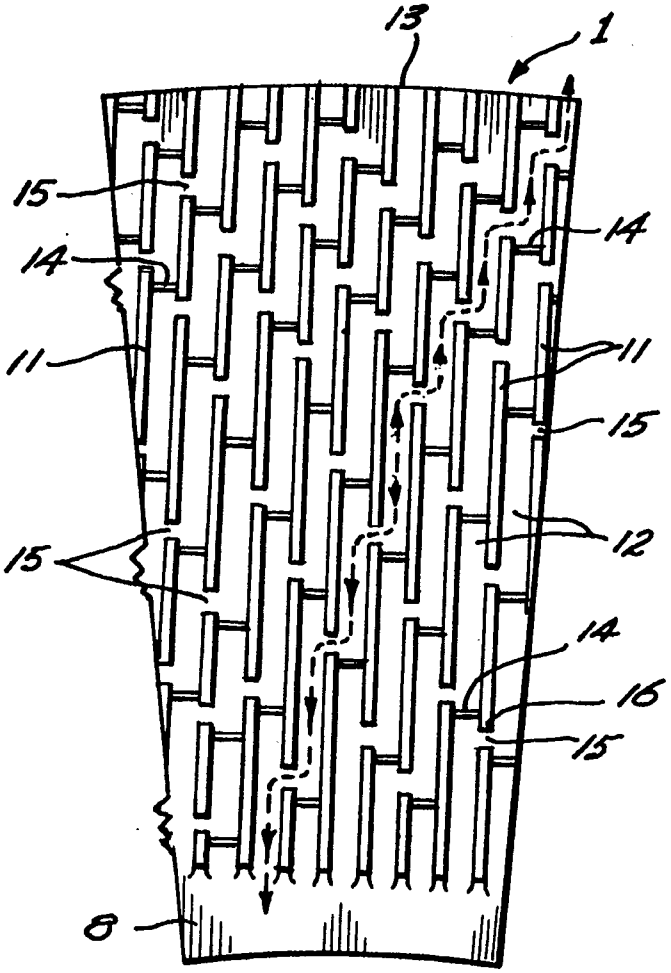
FIG. 6 is a fragmentary face view of a portion of a modified type of refining disk.

By sizing the intergroove slots 15 differently, the direction of the steam flow can be controlled to flow in a different pattern. In FIG. 6 the slots 15 in the zigzag steam venting paths are wider progressively outward and also progressively inward from the half radius of the disk so as to promote escape of steam both toward the peripheries of the disks and toward the central portions of the disks. In the outer portions of the disks the intergroove slots are adjacent to the inner sides of the dams and in the inner portions of the disks the intergroove slots adjacent to the outer sides of the dams.

Figure 7:
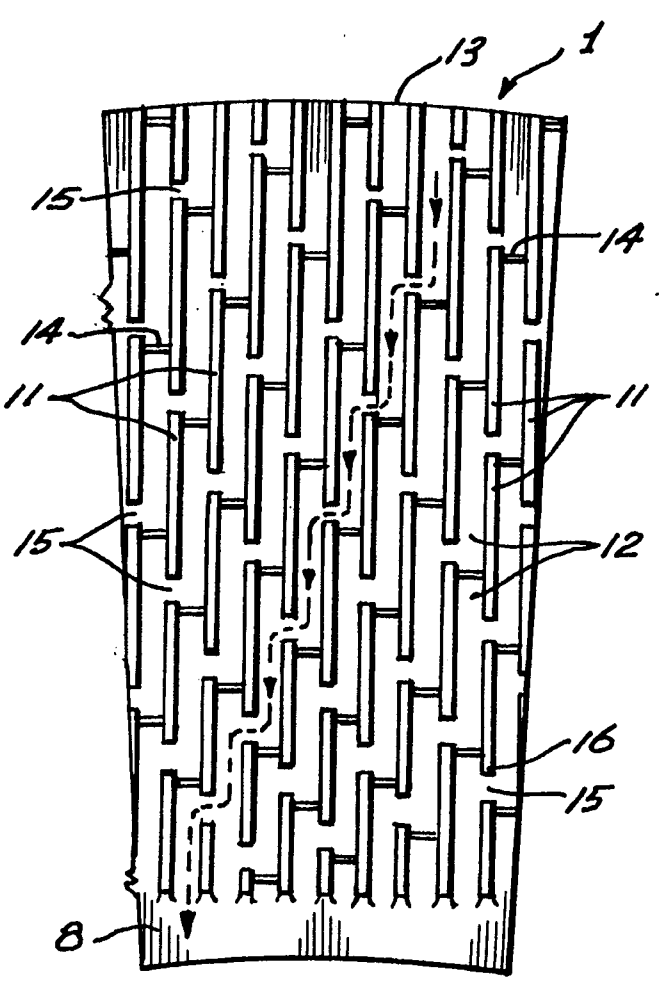
FIG. 7 is a fragmentary face view of a portion of a further modified type of refining disk.

In the further modified type of refiner disks shown in FIG. 7, the slots 15 are adjacent to the radial outer sides of the dams 14 and the dams and slots in circumferentially adjacent ribs are arranged progressively farther toward the centers of the disks so that a zigzag steam venting path will be formed progressing toward the central portions of the disks. Also the intergroove slots are progressively wider toward the centers of the disks to promote venting flow of steam toward the central portions of the disks.

Consequently, as a result of providing the intergroove slots 15, steam is vented more easily from the refining space 9, the refining operation is more effective, the axial bearing load is reduced, and the power required for the refining operation is considerably decreased.

I claim:

1. In a refiner having coaxial coacting refining disks, the refining surface of one disk having generally radial ribs forming generally radial grooves therebetween blocked at intervals by radially spaced dams to form pockets, at least some of the ribs having intergroove slots connecting neighboring pockets, two of such slots being located between the two dams of a pocket and spaced radially to enable steam to enter the pocket through one of such two slots, flow radially along the pocket and exit from the pocket through the other of such two slots, the improvement comprising a radial rib having in it at least three slots connecting the pockets on opposite sides of such rib, and such three slots being spaced apart progressively greater distances radially along such rib.

2. In the refiner defined in claim 1, the three slots being spaced apart progressively greater distances radially inward along the rib to favor flow of steam toward the periphery of the disk.

3. In the refiner defined in claim 1, the three slots being spaced apart progressively greater distances radially outward along the rib to favor flow of steam toward the center of the disk.

4. In a refiner having coaxial coacting refining disks, the refining surface of one disk having generally radial ribs forming generally radial grooves therebetween blocked at intervals by radially spaced dams to form pockets, at least some of the ribs having intergroove slot means connecting neighboring pockets, two of such slot means being located between the two dams of a pocket and spaced radially to enable steam to enter the pocket through one of such two slot means, flow radially along the pocket and exit from the pocket through the other of such two slot means, the improvement comprising the one of such two slot means closer to the periphery of the disk being larger than the other of such two slot means farther from the periphery of the disk to favor flow of steam toward the periphery of the disk.

5. In a refiner having coaxial coacting refining disks, the refining surface of one disk having generally radial ribs forming generally radial grooves therebetween blocked at intervals by radially spaced dams to form pockets, at least some of the ribs having intergroove slot means connecting neighboring pockets, two of such slot means being located between the two dams of a pocket and spaced radially to enable steam to enter the pocket through one of such two slot means, flow radially along the pocket and exit from the pocket through the other of such two slot means, the improvement comprising the one of such two slot means closer to the center of the disk being larger than the other of such two slot means closer to the periphery of the disk to favor flow of steam toward the center of the disk.

* * * * *

UNITED STATES PATENT AND TRADEMARK OFFICE

CERTIFICATE OF CORRECTION

PATENT NO. : 5,373,995

DATED : December 20, 1994

INVENTOR(S) : Ola M. Johansson

It is certified that error appears in the above-indentified patent and that said Letters Patent is hereby corrected as shown below:

Title page, item [76], inventor: should read--Ola M. Johansson--.

Signed and Sealed this

Twenty-fourth Day of September, 1996

*Attest:*

Bruce Lehman

BRUCE LEHMAN

*Attesting Officer*

*Commissioner of Patents and Trademarks*